United States Patent [19]

Boisvert et al.

[11] Patent Number: 4,813,157

[45] Date of Patent: Mar. 21, 1989

[54] ADJUSTABLE SHOE INSOLE

[76] Inventors: Michelle Boisvert, 7017A, St-Vallier Street, Montreal, Canada, H2S 2R3; Pierre C. Lepine, 6606 Monk Boulevard - Apt. 3, Montreal, Canada, H4E 3J1

[21] Appl. No.: 928,999

[22] Filed: Nov. 10, 1986

[30] Foreign Application Priority Data

Jul. 21, 1986 [CA] Canada ..... 514322

[51] Int. Cl.[4] ..... A43B 13/40; A43B 13/38

[52] U.S. Cl. ..... 36/44; 36/91; 128/586

[58] Field of Search ..... 36/44, 71, 91, 43; 128/586, 596, 601, 602, 619, 622

[56] References Cited

U.S. PATENT DOCUMENTS

| | | | |
|---|---|---|---|
| 1,370,799 | 3/1921 | Egerton | 36/44 |
| 1,477,750 | 12/1923 | Endrea | 128/619 |
| 1,957,695 | 5/1934 | Chiappetta | 128/601 |
| 2,080,320 | 5/1937 | Knapp | 128/619 |
| 2,184,456 | 12/1939 | Knapp | 36/44 |
| 2,366,116 | 12/1944 | Lederman | 128/596 |
| 2,491,280 | 12/1949 | Roth | 36/44 |
| 2,572,670 | 10/1951 | Schwartz | 36/44 |
| 2,585,692 | 2/1952 | Scholl | 36/44 |
| 2,755,569 | 7/1956 | Guy | 128/619 |
| 2,790,254 | 4/1957 | Burns | 36/71 |
| 3,071,877 | 1/1963 | Stickles | 36/44 |
| 3,084,695 | 4/1963 | O'Donnell | 128/619 |
| 3,265,071 | 8/1966 | Kirchner et al. | 128/586 |
| 3,316,663 | 5/1967 | Neu | 36/71 |

FOREIGN PATENT DOCUMENTS

| | | | |
|---|---|---|---|
| 563653 | 9/1958 | Canada . | |
| 401076 | 11/1933 | United Kingdom | 36/43 |

*Primary Examiner*—Steven N. Meyers

[57] ABSTRACT

A shoe pad or insole with areas of adjustable thickness for fitting various shapes of feet in a shoe, boot or the like. The insole comprises superimposed pad layers made of a flexible material, such as leather, for the top layer and cork for the remaining pad layers. A pressure adhesive, such as hot-melt glue, is used to releasably interconnect the superimposed pad layers, so as to allow repeated peel-off removal and reconnection thereof, for specific adjustment of the thickness of various insole areas of the insole for best fit of the foot inside the shoe. This includes discrete thickness adjustment of the arch-support portion of the insole and of the front and rear portions thereof.

14 Claims, 2 Drawing Sheets

ADJUSTABLE SHOE INSOLE

FIELD OF THE INVENTION

This invention relates to a removable shoe pad or insole for loose engagement in an article of footwear.

BACKGROUND OF THE INVENTION

In an article of footwear, such as shoe or a boot, it is sometimes necessary to use a removable insole. An insole will reduce the inner volume of the shoe, for better fit of the foot into the slightly too large shoe. If the insole is previously treated with appropriate chemicals, it may counter bad odours generated by the foot. The insole may induce some ventilation in the shoe, and increase comfort of the foot due to its cushioning effect. The insole may also increase the useful lifespan of the shoe, by absorbing the moisture generated by the foot, said moisture comprising chemical compounds that are damaging in the long run to the shoe material.

Broadly speaking, conventional removable insoles are made of a single sheet of material, conforming to the shape of the sole of the foot. In the prior art, means have been proposed to prevent some lateral or fore and aft sliding of the insole in the shoe: see Canadian Pat. No. 563,653. Also, further means have been suggested for providing a contoured insole, whereby the portions of the insole in register with the side edges and the ball of the foot are thicker, for better comfort: see U.S. Pat. No. 2,790,254.

All these insoles are to be used as such: either they are used, or they are removed from the shoe. This is inefficient, in that a manufacturer will have to make up a large number of variably dimensioned such insoles, to satisfy his clientele. Moreoever, these known insoles have no means whereby minute adjustments of their thickness may be possible.

And what is more, there are some persons who face a great deal of difficulty in finding the shoe of the appropriate dimensions, since they have relatively narrower or larger or shorter or longer feet, or have slightly different foot contour than those fitting standardized shoe sizes. Such persons may have to pay more than others for their shoes, since they require custom made ones, while conventional insoles are of no help to them.

OBJECTS OF THE INVENTION

The object of the invention is thus to find a way to construct an insole that would counter the abovenoted deficiencies.

The gist of the present invention is to provide an insole for enabling persons, whose feet have a shape not accounted for by conventional shoe manufacturers, to buy conventional shoes without having to modify the latter, inserting said insole, so as to obtain an excellent fit.

A further object of the insole of the invention, is to permit discrete adjustment of the contour and thickness of the arch-supporting portion of the insole, for perfect fit of a foot into a shoe.

A further object of the invention is to allow better lateral stability of the foot supported in a shoe over said insole.

An object of the invention is to prevent formation of so-called "flat-feet".

Another object of the invention is that the manufacturing of the insole be cheap and easy.

Another object of the invention is to generally increase the level of comfort of a normally-shaped foot in a shoe.

Still another object of the invention is to ensure correct posture of the foot standing on the insole in the shoe, for proper orthopedics, weight distribution, and to prevent undue restriction of the blood circulation or stretching of the foot ligaments.

SUMMARY OF THE INVENTION

An insole for supporting at least a portion of the sole of a foot in a footwear; the insole comprising superimposed pad layers, the top pad layer including score lines dividing same layer into a number of corresponding top pad layer portions which can be peeled off from the bottom pad layer; said pad layers made of a flexible material and said top pad layer portions being of different sizes; and glue means releasably interconnecting said pad layers and permitting repeated peel-off removal and reconnection thereof; for specific adjustment of the thickness of different areas of said insole for best fit of the foot inside said footwear.

Advantageously, said bottom pad layer is made of cork. Profitably, said top pad layer is made of leather and superimposed directly over said bottom pad layer.

Preferably, said top pad layer conforms to the general shape of a foot; said top pad layer further including two opposite flaps, outwardly projecting from the side edges of the front portion of said top pad layer and adapted to upwardly fit against the side walls of the footwear.

Advantageously, further top pad layer score lines are provided between said flaps and the adjacent section of said top pad layer.

Profitably, the thickness of each of said flaps tapers toward a thin outer peripheral edge thereof.

Preferably, a further generally circular scoreline is made in the top pad layer about a front ball-ofthe-foot portion thereof, and defining a circular top pad layer portion that is temporarily removable and reengageable.

Advantageously, there is further included a smaller front pad layer releasably adhering to the underside of and conforming to the general shape of the front portion of said main pad layer.

Profitably, an arcuate score line is made in the top pad layer about a concave arch-of-the-foot portion of said top pad layer, and said bottom pad layer further includes an arch-of-the-foot cavity in register with the arch-of-the-foot portion of the top pad layer.

Preferably, a stack of arch-of-the-foot pad layers is releasably adhered to each other, one of which fits said cavity, and the remainder of which are of progressively-decreasing similar dimensions in a direction away from said top pad layer.

It is envisioned that the radius of curvature of said concave arch-of-the-foot portion of said top pad layer be of a length about equal to the length of said insole.

Also, said arch-of-the-foot cavity of the main pad layer could include a front pronouncely-curved edge portion and a rear straight outwardly-diverging edge portion; said cavity having a width transversely of said main pad layer equal to two thirds the width of said top pad layer in its middle portion registering with said cavity.

Preferably, said pad layers are of substantially same thickness.

Advantageously, said glue means consists of a pressure adhesive.

DETAILED DESCRIPTION OF THE INVENTION

Figure 1:
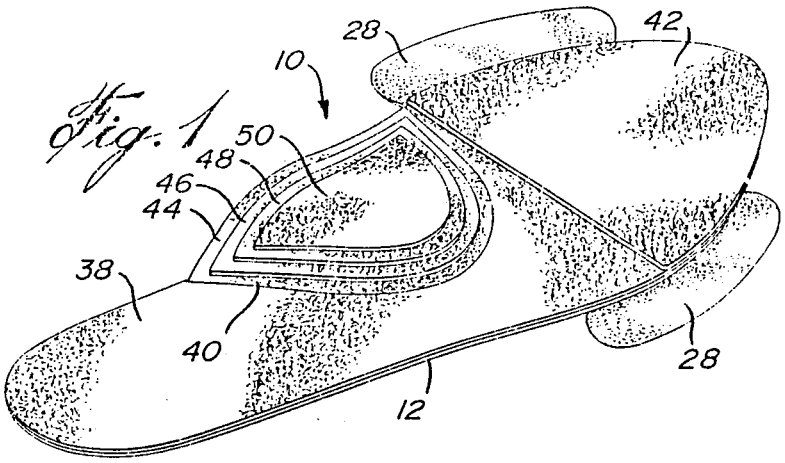
FIG. 1 is a bottom perspective view of an insole made accordingly with the teachings of the invention.
Figure 3:
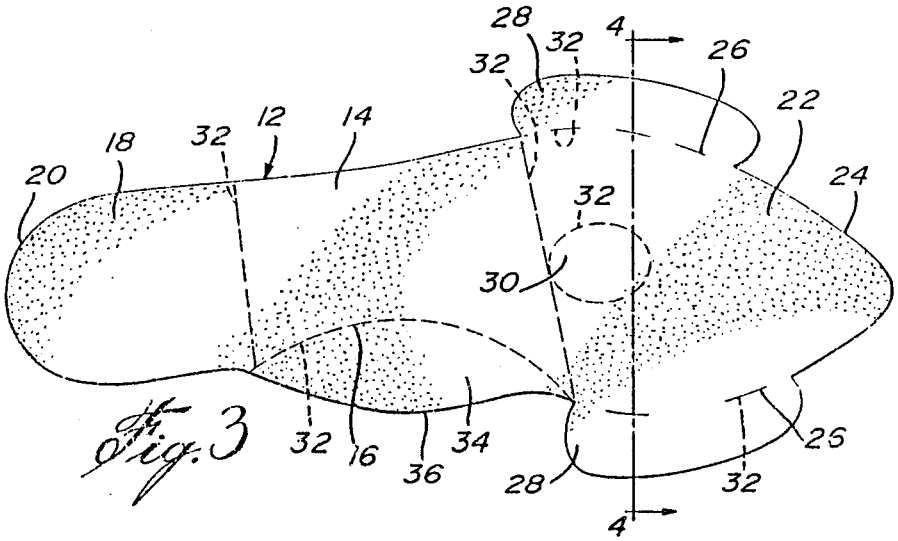
FIG. 3, on the first sheet of drawings, is a top plan view of said insole, showing score lines for detaching sections of the insole.
Figure 5:
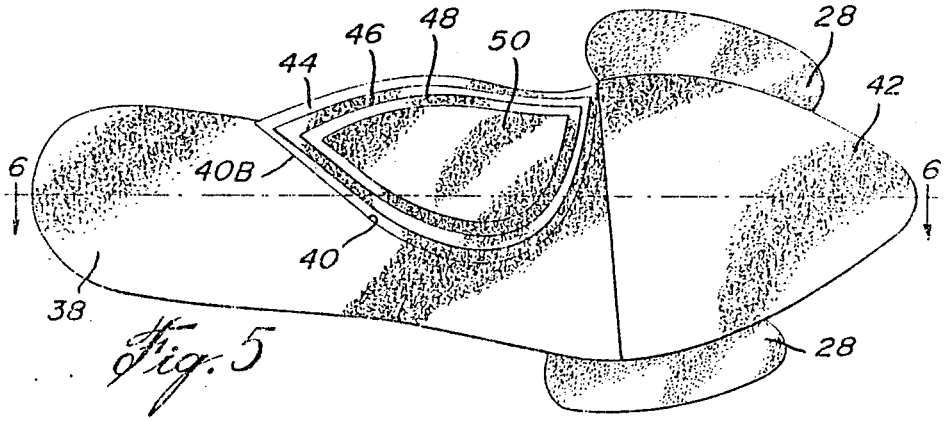
FIG. 5, on the first sheet of drawings, is a bottom plan view of said insole.
Figure 2:
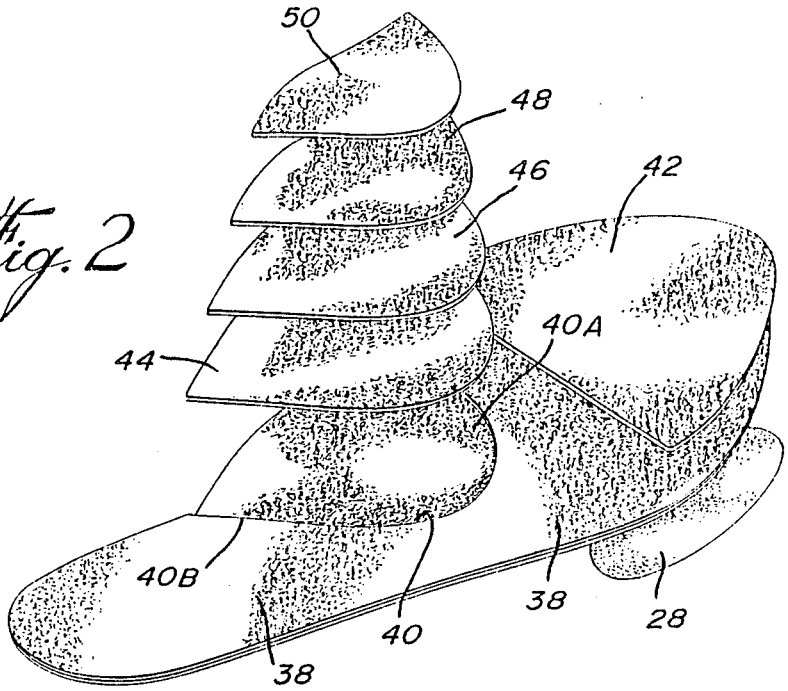
FIG. 2 is an exploded bottom perspective view of said insole.
Figure 4:
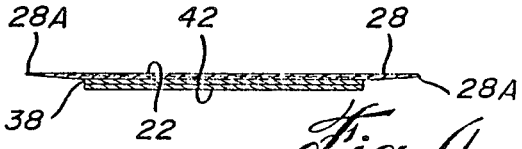
FIG. 4, on the second sheet of drawings, is a cross-sectional view taken along line 4—4 of FIG. 3.
Figure 6:
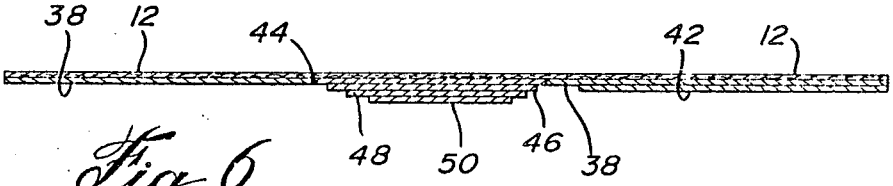
FIG. 6, on the second sheet of drawings, is a longitudinal sectional view taken along line 6—6 of FIG. 5.

A preferred embodiment of the insole of the invention is illustrated in the annexed drawings, and referred to by numeral 10. Insole 10 comprises a main top pad layer 12, made preferably of leather. Layer 12 conforms to the general shape of the sole of a foot. Layer 12 includes a main intermediate portion 14, of substantially rectangular shape but enlarging toward the front and having a concave inner edge 16 wich is interiorly curved about a circle of arc whose radius is of a length about equal to the length of the insole 10; a rear heel portion 18, also substantially rectangular except for its rearmost rounded edge 20; and a front toe portion 22, defining a frontmost somewhat pointed edge 24, and convex side walls 26. Outwardly-projecting rounded flaps 28 are further added to side walls 26. The thickness of the outer edge portion of each flap 28 tapers outwardly, defining a thinner peripheral edge 28A. Front portion 22 includes a central circular bunion portion 30 in registry with the ball of a foot standing on the insole 10, and adjacent main portion 14. Circular bunion portion 30 tangentially registers with the front edge of main portion 14.

The leather of pad 12 has score lines 32 which allow the tearing of parts from the insole 10, for the purpose of adjusting the thickness of the selected areas of the insole of a given shoe and foot. These score lines 32 are made: (a) around bunion portion 30; (b) in between rear portion 18 and main portion 14; (c) in between front portion 22 and main portion 14; (d) in between each flap 28 and the front portion 22; and (e) between main portion 14 and arch support part 34. A score line 32 coincides with curved edge 16. Part 34 is coplanar to main portion 14, and defines a convex outer edge 36.

Portions 18, 22, 28, and 34, if removed, cannot be reconnected to the other portions of the top layer 12; but portion 30 could of course be repositioned in place after its temporary removal from portion 22 (due to the conceivably temporary duration of the presence of the bunion provided appropriate posterior medical treatment).

To the underface of top layer 12 is releasably glued a main bottom pad layer 38, made preferably of cork. The glue used for this purpose is a pressure adhesive, preferably a spacially plasticised, silicone based so-called "hot-melt-glue", that will allow repeated peeling off and adhering of the two layers. Such a glue is sold under the registered trade mark Helmitherme by Helmitin Inc. Cork layer 38 follows exactly the contour of top layer portions 18 and 22, and substantially that of portion 14 except for its inner edge 40. Inner edge 40 does not coincide with top layer score line 32 along edge 16. The cavity defined by edge 40 has a width at its interiormost portion about two third of the width of main portion 14. Moreover, edge 40 is different in that it defines a pronouncely curved front edge portion 40A and a straight outwardly divergent rear edge portion 40B. A pad layer 42, made preferably of cork material, is removably adhered to the front portion of the underface of pad layer 38. Pad layer 42 is of a dimension identical to that of top layer portion 22 and it registers therewith to form a third insole layer.

a further pad layer 44 is secured by the hot-melt glue to the underface of top layer portion 34 in the cavity defined by edge 40, and its contour follows exactly the top layer outer edge 36. Pad layer 44 is coplanar with bottom pad layer 38.

Still further, a pad layer 46 is releasably glued to the underside of pad layer 44, a pad layer 48 to the underside of pad layer 46, and a pad layer 50 to the underside of pad layer 48, in superimposed fashion, all by hot-melt glue. Pad layers 44 to 50 are also of cork and of similar yet progressively decreasing dimensions, pad layer 44 being the largest and pad layer 50 the smallest. Pad layer 46 is coplanar with the front, third pad layer 42. Pad layers 48 and 50 define fourth and fifth lowermost layers.

Thus, pad layer 42 can be removed, for greater toe room; and/or any one or combination of or even all four pad layers 44–50 can be removed, for best adjusted comfort in foot arch support. This peeling off of the pad layers 42-50 helps in providing utmost adjustability and thus comfort to the user, in that they provide a contoured top surface. Top pad layer portion 34 is adapted to cooperate with pad layers 44 to 50. Lateral flaps 28 provide lateral position adjustment of the foot in the shoe, but can be removed along their score line 32 if such adjustment is unnecessary. Flaps 28 extend upward, against the side walls of the shoe.

It is to be understood that all possible combinations of pads and layer portions are envisioned, including removing both cork and leather layers about a given insole portion, so that a portion of the sole of the foot may lie directly on the inside of the shoe.

While cork is preferably used as a constituting material, it is to be understood that other comparatively firm but resilient material can be used instead.

All the pad layers are preferably of substantially the same thickness.

What we claim is:

1. An insole for supporting at least a portion of the sole of a foot in a footwear; the sole comprising superimposed pad layers including top and bottom superimposed pad layers, the top pad layer including score lines dividing same layer into a number of corresponding top pad layer portions which can be peeled off from the bottom pad layer; said pad layers made of a flexible material and said top pad layer portions being of different sizes; and glue means releasably interconnecting said pad layers and permitting repeated peel-off removal and reconnection thereof, for specific adjustment of the thickness of different areas of said insole for best fit of the foot inside said footwear.

2. An insole as defined in claim 1, wherein said bottom pad layer is made of cork.

3. An insole as defined in claim 2, wherein said top pad layer is made of leather and superimposed directly over said bottom pad layer.

4. An insole as defined in claim 1, wherein said top pad layer conforms to the general shape of a foot; said top pad layer further including two opposite flaps, outwardly projecting from the side edges of the front portion of said top pad layer and adapted to upwardly fit against the side walls of the footwear.

5. An insole as defined in claim 4, wherein further top pad layer score lines are provided between said flaps and sections of said top pad layer adjacent thereto.

6. An insole as defined in claim 4, wherein the thickness of each of said flaps tapers toward a thin outer peripheral edge thereof.

7. An insole as defined in claim 1, wherein a further generally circular scoreline is made in the top pad layer about a front ball-of-the-foot portion thereof, and defining a circular top pad layer portion that is temporarily removable and reengageable.

8. An insole as defined in claim 1, further including a smaller front pad layer releasably adhering to the underside of and conforming to the general shape of the front portion of said bottom pad layer.

9. An insole as defined in claim 1, wherein an arcuate score line is made in the top pad layer about a concave arch-of-the-foot portion of said top pad layer, and said bottom pad layer further includes an arch-of-the-foot cavity corresponding to the arch-of-the-foot portion of the top pad layer.

10. An insole as defined in claim 9, further including a stack of arch-of-the-foot pad layers releasably adhered to each other, one of which fits said cavity, and the remainder of which are of progressively decreasing similar dimensions in a direction away from said top pad layer.

11. An insole as defined in claim 9, wherein the radius of curvature of said concave arch-of-the-foot portion of said top pad layer is of a length about equal to the length of said insole.

12. An insole as defined in claim 9, wherein said arch-of-the-foot cavity of the bottom pad layer includes a front pronouncely curved edge portion and a rear straight outwardly diverging edge portion; said cavity having a width transversely of said main pad layer equal to two third the width of said top pad layer in its middle portion registering with said cavity.

13. An insole as defined in claim 1, wherein said pad layers are of substantially same thickness.

14. An insole as defined in claim 1, wherein said glue means consists of a pressure adhesive.

* * * * *